US010736186B2

(12) United States Patent
An et al.

(10) Patent No.: US 10,736,186 B2
(45) Date of Patent: Aug. 4, 2020

(54) COOKING APPLIANCE

(71) Applicants: GUANGDONG MIDEA KITCHEN APPLIANCES MANUFACTURING CO., LTD., Foshan (CN); MIDEA GROUP CO., LTD., Foshan (CN)

(72) Inventors: Mingbo An, Foshan (CN); Qihong Ling, Foshan (CN)

(73) Assignees: GUANGDONG MIDEA KITCHEN APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 323 days.

(21) Appl. No.: 15/845,941

(22) Filed: Dec. 18, 2017

(65) Prior Publication Data

US 2018/0343712 A1 Nov. 29, 2018

(30) Foreign Application Priority Data

May 24, 2017 (CN) ..... 2017 1 0373770
May 24, 2017 (CN) ..... 2017 2 0590787 U

(51) Int. Cl.
*H05B 6/76* (2006.01)
*H05B 6/80* (2006.01)
(Continued)

(52) U.S. Cl.
CPC ..... *H05B 6/763* (2013.01); *H05B 6/6408* (2013.01); *H05B 6/6414* (2013.01); *H05B 6/664* (2013.01); *H05B 6/80* (2013.01)

(58) Field of Classification Search
CPC .... H05B 6/6414; H05B 6/664; H05B 6/6408; H05B 6/763
(Continued)

(56) References Cited

U.S. PATENT DOCUMENTS 4,728,762 A * 3/1988 Roth ..... A47J 36/027 219/730
4,814,571 A * 3/1989 Bowen ..... H05B 6/6426 126/340
(Continued)

FOREIGN PATENT DOCUMENTS

CN 1751635 A 3/2006
CN 102860745 A 1/2013
(Continued)

OTHER PUBLICATIONS

Guangdong Midea Kitchen Appliances Manufacturing Co., Ltd., International Search Report and Written Opinion, PCTCN2016070189, dated Apr. 11, 2016, 19 pgs.
(Continued)

*Primary Examiner* — Janie M Loeppke
(74) *Attorney, Agent, or Firm* — Morgan, Lewis & Bockius LLP

(57) ABSTRACT

The present disclosure provides a cooking appliance, comprising a base and an oven door articulated with the base, wherein the cooking appliance further comprises a cooking platform and a microwave shield, the cooking platform comprises a frame and a carrier plate mounted on the frame, the carrier plate is made of a non-microwave shielding material, the frame is detachably mounted on a top plate of the base, an abutting supporting surface is formed between the lower surface of the frame and the upper surface of the top plate, a magnetron is mounted at the bottom of the top plate, the magnetron is used for emitting microwaves from the inner side of the supporting surface to the carrier plate, and the microwave shield is mounted on the top plate, surrounds the outer side of the supporting surface and is used for shielding the microwaves leaked from the supporting surface.

14 Claims, 4 Drawing Sheets

(51) Int. Cl.
*H05B 6/64* (2006.01)
*H05B 6/66* (2006.01)

(58) Field of Classification Search
USPC ..... 219/729, 742, 743, 739, 762, 763
See application file for complete search history.

(56) References Cited

U.S. PATENT DOCUMENTS

| | | | | |
|---|---|---|---|---|
| 7,449,665 | B2 * | 11/2008 | Fadelli ..... | A47J 37/0611 219/680 |
| 2012/0312809 | A1 * | 12/2012 | Wang ..... | H05B 6/6426 219/756 |

FOREIGN PATENT DOCUMENTS

| | | | |
|---|---|---|---|
| CN | 104864427 | A | 8/2015 |
| CN | 104879800 | A | 9/2015 |
| CN | 104879801 | A | 9/2015 |
| CN | 104902604 | A | 9/2015 |
| CN | 204786622 | U | 11/2015 |
| CN | 204786623 | U | 11/2015 |
| CN | 204786624 | U | 11/2015 |
| CN | 204810584 | U | 11/2015 |
| KR | 100643893 | B1 | 11/2006 |

OTHER PUBLICATIONS

Guangdong Midea Kitchen Appliances Manufacturing Co., Ltd., International Preliminary Report on Patentability, PCTCN2016070189, dated Sep. 26, 2017, 5 pgs.

* cited by examiner

COOKING APPLIANCE

PRIORITY CLAIM AND RELATED APPLICATION

This application claims priority to Chinese Patent Application No. 201710373770.4, filed with the State Intellectual Property Office of the People's Republic of China on May 24, 2017 and Chinese Patent Application No. 201720590787.0, filed with the State Intellectual Property Office of the People's Republic of China on May 24, 2017, both of which are incorporated herein by reference in their entirety.

FIELD OF INVENTION

The present disclosure relates to the field of kitchen appliances, and in particular relates to a cooking appliance.

BACKGROUND

With the development of the times, cooking appliances are increasingly diverse. At present, a novel cooking appliance for barbecue appears in the market, and the cooking appliance can be used for heating Panini food, sandwich, etc. The cooking appliance includes a base and an oven door articulated with the base, an accommodating cavity for accommodating food to be cooked is formed on the lower surface of the oven door, the oven door can rotate up and down relative to the base to open or close the accommodating cavity, a top plate of the base is provided with a mounting cavity for mounting a heating tube, a carrier plate for supporting food to be heated is mounted at the top of the mounting cavity, a magnetron is further mounted in the base of the cooking appliance, microwaves emitted by the magnetron penetrate the carrier plate to heat the food, thus, the carrier plate must be made of a non-microwave shielding material, e.g., glass; furthermore, the carrier plate must be connected to the top plate of the base in a sealed manner in order to prevent microwave leakage. In the prior art, the carrier plate is bonded to the top plate of the base via silica gel, and the fragile carrier plate is easily broken when the product is used; therefore, when the carrier plate is damaged, the silica gel connecting the carrier plate with the top plate of the base needs to be removed so as to take down the broken carrier plate, and a new carrier plate is fixed on the top plate of the base in a sealed manner by using silica gel, so the replacing process is very troublesome, the maintenance takes a long time, and the satisfaction of customers declines; besides, the problem of microwave leakage caused by poor seal is easily caused by replacing the carrier plate, so a potential safety risk exists.

SUMMARY

The present disclosure aims to solve at least one of the technical problems disclosed in the background.

Thus, an object of the present disclosure is providing a cooking appliance facilitating replacement of a carrier plate and avoiding microwave leakage.

To achieve the above object, an embodiment of the present disclosure provides a cooking appliance, including a base and an oven door articulated with the base, wherein the cooking appliance further includes a cooking platform and a microwave shield, the cooking platform includes a frame and a carrier plate mounted on the frame, the carrier plate is made of a non-microwave shielding material, the frame is detachably mounted on a top plate of the base, an abutting supporting surface is formed between the lower surface of the frame and the upper surface of the top plate, a magnetron is mounted at the bottom of the top plate, the magnetron is used for emitting microwaves from the inner side of the supporting surface to the carrier plate, and the microwave shield is mounted on the top plate, surrounds the outer side of the supporting surface and is used for shielding the microwaves leaked from the supporting surface.

In this solution, the carrier plate and the top plate of the base are designed to be separate, the frame is mounted at the edge of the carrier plate to form the cooking platform, the cooking platform is detachably mounted on the top plate of the base via the frame, and when the carrier plate is broken, the original cooking platform is detached from the top plate of the base and a new cooking platform is directly mounted on the top plate of the base, so the maintenance operation is simple, takes a little time and is beneficial to improving the satisfaction of users. Besides, in the solution, the microwave shield is arranged on the top plate of the base and surrounds the outer side of the supporting surface between the frame and the top plate of the base, and thus even if the supporting surface has a gap, the microwaves emitted from the gap are shielded by the microwave shield but not leaked to the exterior of the base, so that the problem of microwave leakage easily caused after the carrier plate is changed is solved and the potential safety risk is eliminated.

Specifically, the supporting surface extends in the peripheral direction of the frame, and the frame is generally a rectangular frame, so the contour of the supporting surface is generally also rectangular; however, if the structural design of the frame is changed, the shape of the supporting surface is also changed accordingly; for example, if the frame is circular or elliptic, the contour of the supporting surface is correspondingly also circular or elliptic; for another example, if a supporting part matched with the top plate of the base is formed at the bottom of the frame, the shape of the supporting surface is determined by the shape of the bottom surface of the supporting part.

In the above technical solution, preferably, the microwave shield is choke teeth.

In this solution, the microwave shield is choke teeth, and the openings of the choke teeth face the supporting surface between the frame and the top plate of the base, so that the microwaves leaked from the supporting surface enter the choke teeth from the openings of the choke teeth and are prevented from being further propagated to the outside, thereby preventing the microwaves from being leaked out of the base.

In any above technical solution, preferably, the frame is detachably connected to the top plate via screws.

In this solution, the cooking platform is fixed to the top plate of the base via screws, and with this design, the operation of detaching and mounting the cooking platform is simple and the cooking platform is convenient to replace.

In any above technical solution, preferably, the outer edge of the top plate extends downward to form a first fixing rib, the first fixing rib is provided with first fixing holes for mounting screws, the outer edge of the frame extends downward to form a second fixing rib, the second fixing rib is provided with second fixing holes for mounting screws, and when the cooking platform is mounted on the top plate, the second fixing rib is located outside the first fixing rib, and the second fixing holes and the first fixing holes are aligned and connected by the screws.

In any above technical solution, preferably, a seal ring is mounted on the supporting surface.

When food put on the carrier plate is heated, some water and oil may seep out of the food; if the connection part of the carrier plate and the frame is not well sealed and has a gap, water and oil are prone to flow from the gap to the top plate of the base, and then flow into the base along the top plate of the base and contact electric devices in the base, causing the problem of damage of the electric devices or short circuit. In order to prevent the problem, in this solution, a seal ring is mounted on the supporting surface, the upper surface of the seal ring abuts against the lower surface of the frame, and the lower surface of the seal ring abuts against the upper surface of the top plate of the base to realize sealing, thereby preventing water and oil generated when the food is heated from flowing into the base.

In any above technical solution, preferably, a mounting cavity that is concave downward is formed in the upper surface of the top plate, the mounting cavity is used for mounting a heating tube and is opposite to the carrier plate, and heat insulation batts are arranged on the bottom walls and side walls of the mounting cavity and cover the bottom walls and side walls of the mounting cavity.

In this solution, the top plate of the base is provided with a mounting cavity for mounting a heating tube, the mounting cavity is located below the carrier plate, and the heat insulation batts cover the bottom walls and side walls of the mounting cavity; such a design prevents heat generated by the heating tube from being transferred to the outside from the bottom walls and side walls of the mounting cavity and reduces heat loss, so that all the heat generated by the heating tube is transferred to the carrier plate to heat food, thereby improving the heating efficiency.

In any above technical solution, preferably, a mounting part for mounting the carrier plate is formed at the inner edge of the frame, the mounting part includes a connecting ring rib extending downward from the inner edge of the frame and a limiting ring rib extending inward from the lower end of the connecting ring rib, the carrier plate is mounted inside the connecting ring rib, and the lower surface of the carrier plate is fixedly connected to the limiting ring rib.

In this solution, a mounting part that is concave downward is formed at the inner edge of the frame and used for mounting the carrier plate, and the longitudinal section of the mounting part is L-shaped, so the structure is simple and the machining difficulty is low. The carrier plate is mounted inside the mounting part, so that the fixing effect of the carrier plate and the frame can be improved and the edge of the carrier plate can be prevented from scratching a user.

In any above technical solution, preferably, when the cooking platform is mounted on the top plate, the lower surface of the limiting ring rib is matched with the upper surface of the top plate to form the supporting surface, and the microwave shield is located between the connecting ring rib and the second fixing rib.

In any above technical solution, preferably, the carrier plate is a glass plate, and the frame, the top plate and the choke teeth are all metal parts.

In any above technical solution, preferably, the carrier plate is fixedly bonded to the frame, and the choke teeth are fixedly welded on the top plate.

With this design, the carrier plate and the choke teeth are fixed in a simple manner, and the fixing reliability is high.

The additional aspects and advantages of the present disclosure will become obvious in the following description or be learnt from practice of the present disclosure.

BRIEF DESCRIPTION OF THE DRAWINGS

The above-mentioned and/or additional aspects and advantages of the present disclosure will become obvious and be easily understood from the description of the embodiments in conjunction with the following accompanying drawings, in which.

Figure 1:
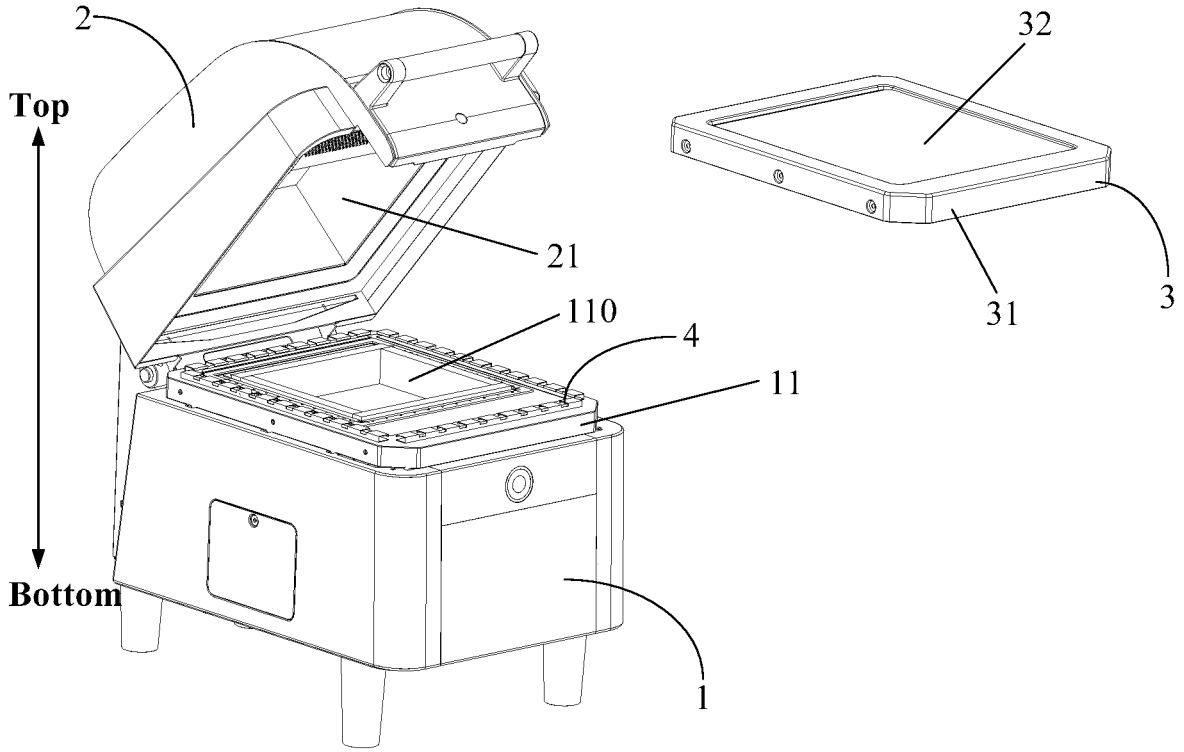
FIG. 1 is a structural schematic diagram of a cooking appliance according to some embodiments of the present disclosure with a cooking platform detached.
Figure 2:
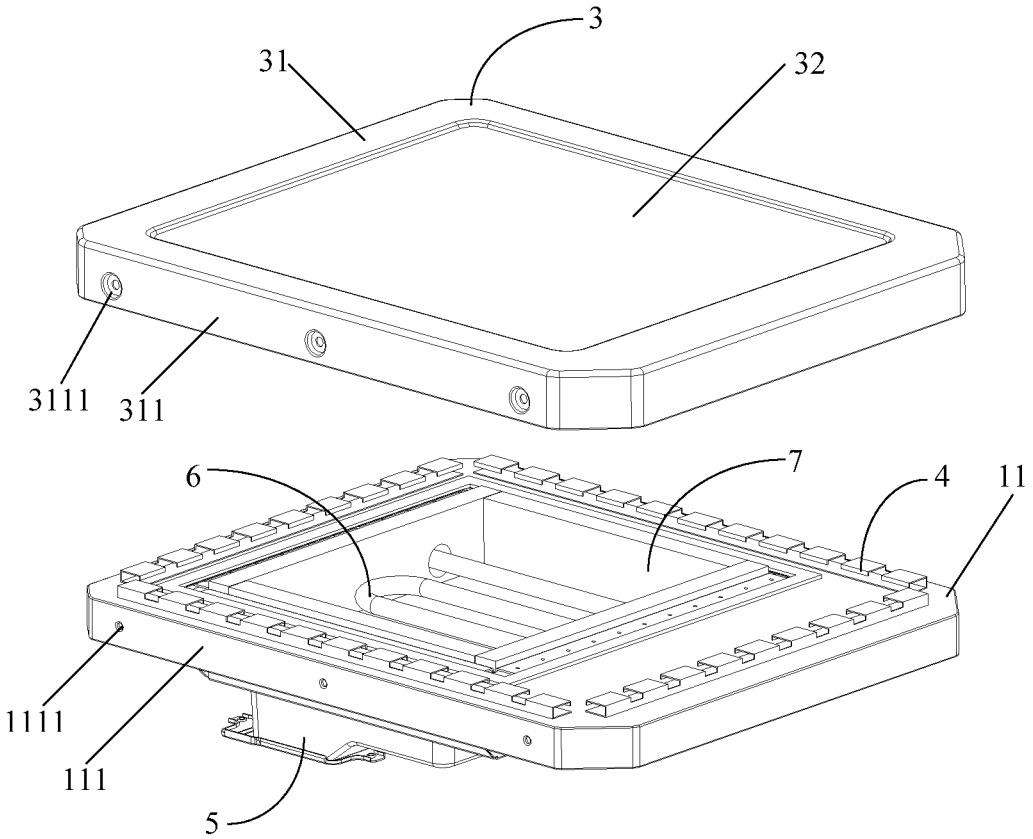
FIG. 2 is a structural schematic diagram of assembly of the cooking platform and a top plate of a base according to some embodiments of the present disclosure.
Figure 3:
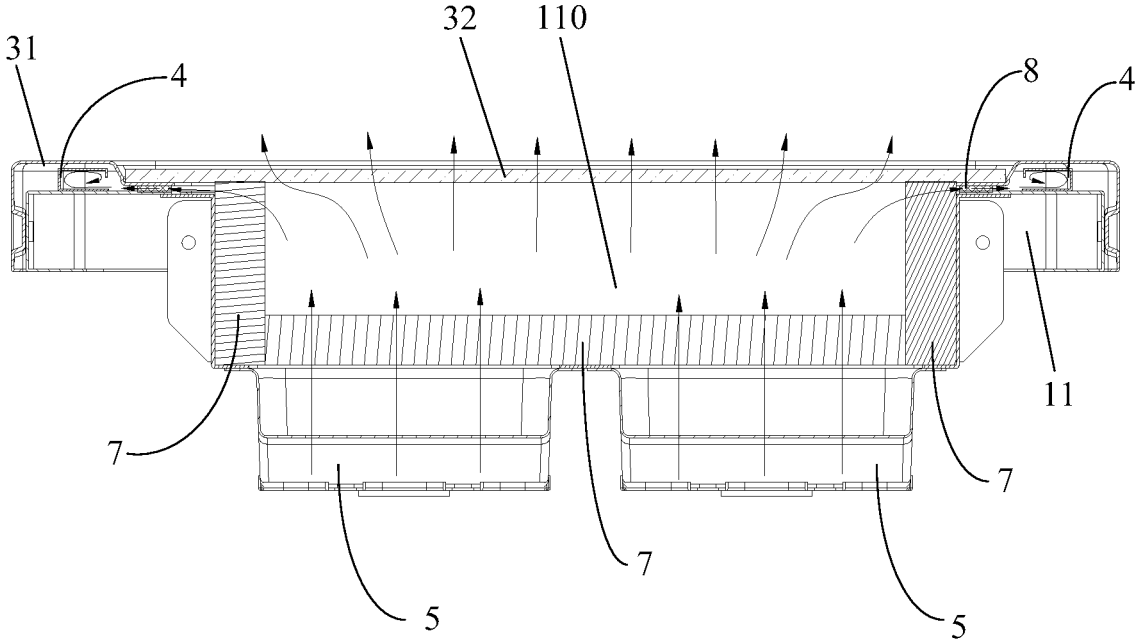
FIG. 3 is a structural schematic diagram after the cooking platform is assembled with the top plate of the base according to some embodiments of the present disclosure.
Figure 4:
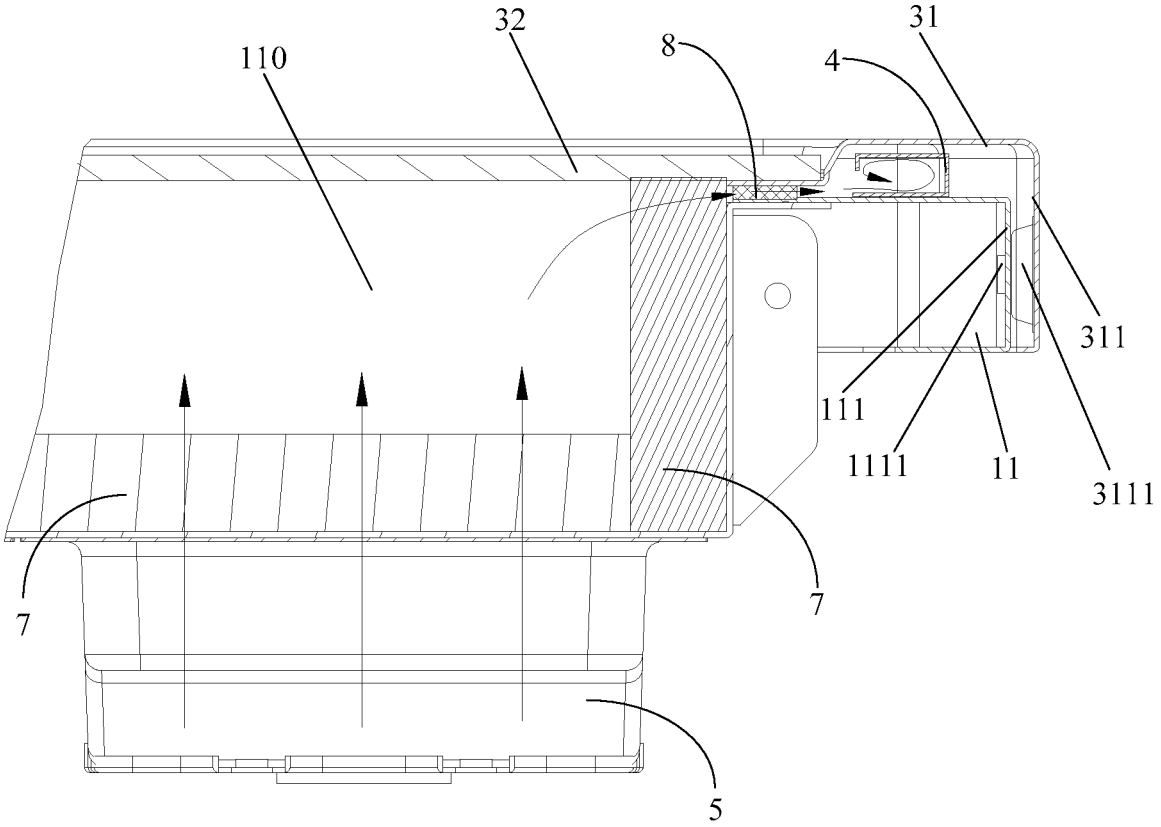
FIG. 4 is a partial enlarged view of FIG. 3.
Figure 5:
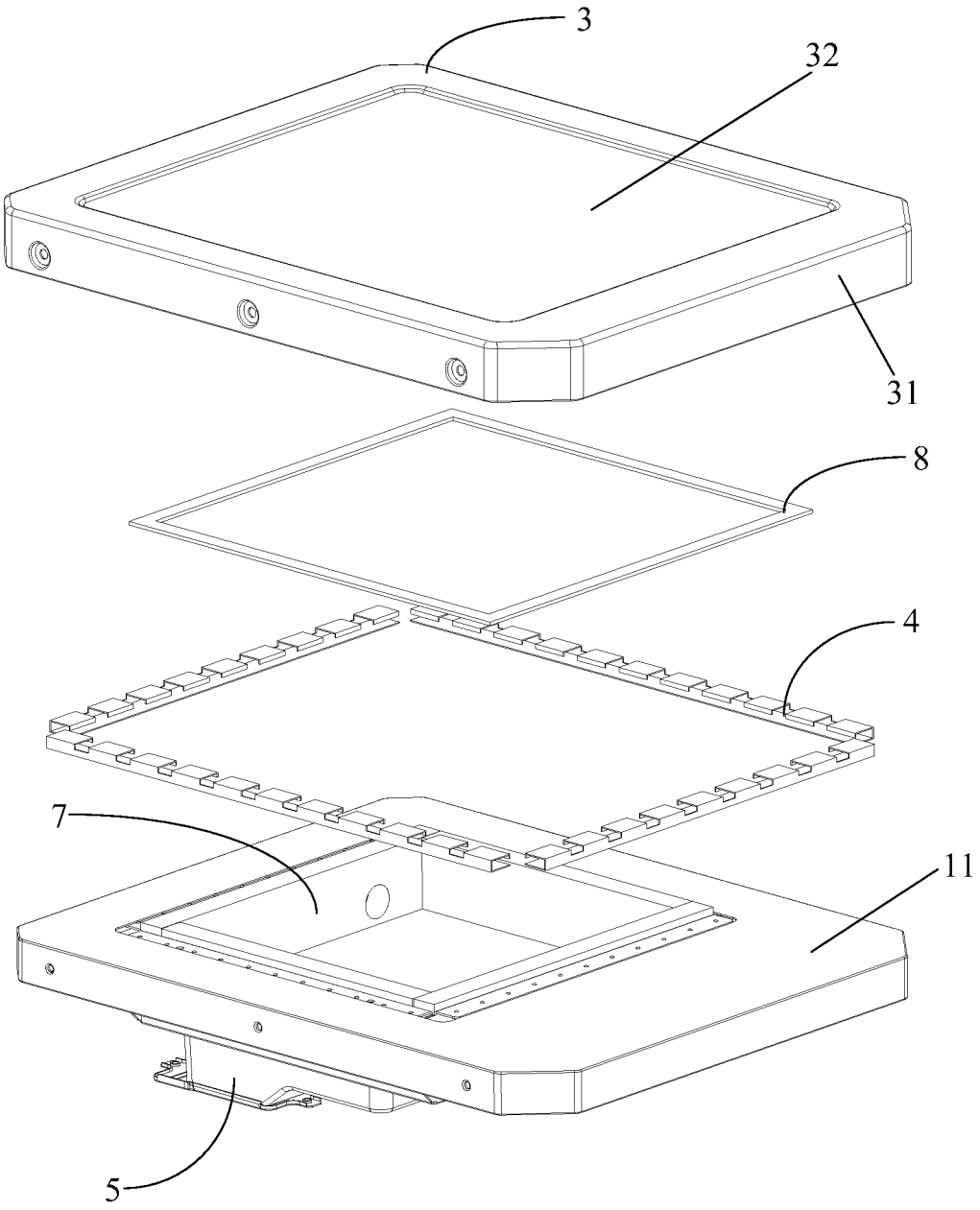
FIG. 5 is a part drawing of the cooking platform and the top plate of the base shown in FIG. 3.

In the drawings, arrows in FIGS. 3 and 4 indicate microwave propagation directions, and the corresponding relations between reference signs and part names in FIGS. 1 to 5 are as follows: base: 1, top plate: 11, mounting cavity: 110, first fixing rib: 111, first fixing holes: 1111, oven door: 2, accommodating cavity: 21, cooking platform: 3, frame: 31, second fixing rib: 311, second fixing holes: 3111, carrier plate: 32, choke teeth: 4, magnetron: 5, heating tube: 6, heat insulation batts: 7, and seal ring: 8.

DETAILED DESCRIPTION OF THE EMBODIMENTS

In order to understand the above objects, features and advantages of the present disclosure more clearly, the present disclosure will be further described in detail below in combination with the accompanying drawings and specific embodiments. It should be noted that the embodiments of the present application and the features in the embodiments may be combined with each other without conflicts.

Elaborated in the following description are many specific details to sufficiently understand the present disclosure. However, the present disclosure may also be implemented in other ways different from those described herein, so the protection scope of the present disclosure is not limited by the following disclosed specific embodiments.

As shown in FIGS. 1-5, the embodiments of the present disclosure provide a cooking appliance, including a base 1 and an oven door 2 articulated with the base 1, an accommodating cavity 21 for accommodating food to be cooked is formed on the lower surface of the oven door 2, the oven door 2 can rotate up and down relative to the base 1 to open or close the accommodating cavity 21, a top plate 11 of the base 1 is provided with a mounting cavity 110 for mounting a heating tube 6, the mounting cavity 110 is opposite to the accommodating cavity 21 when the oven door 2 is closed, the cooking appliance further includes a cooking platform 3 and a microwave shield, the cooking platform 3 includes a frame 31 and a carrier plate 32 mounted on the frame 31, the carrier plate 32 is made of a non-microwave shielding material, the frame 31 is detachably mounted on the top plate 11 of the base 1 so that the carrier plate 32 is opposite to the accommodating cavity 21 and the mounting cavity 110, an abutting supporting surface is formed between the lower surface of the frame 31 and the upper surface of the top plate 11, a magnetron 5 is mounted at the bottom of the top plate 11, the magnetron 5 is used for emitting microwaves from the inner side of the supporting surface to the carrier plate 32, and the microwave shield is mounted on the top plate 11, surrounds the outer side of the supporting surface and is used for shielding the microwaves leaked from the supporting surface.

In this solution, the carrier plate 32 and the top plate 11 of the base 1 are designed to be separate, the frame 31 is mounted at the edge of the carrier plate 32 to form the cooking platform 3, the cooking platform 3 is detachably mounted on the top plate 11 of the base 1 via the frame 31, and when the carrier plate 32 is broken, the original cooking platform 3 is detached from the top plate 11 of the base 1 and a new cooking platform 3 is directly mounted on the top plate 11 of the base 1, so the maintenance operation is simple, takes a little time and is beneficial to improving the satisfaction of users. Besides, in this solution, the microwave shield is arranged on the top plate 11 of the base 1 and surrounds the outer side of the supporting surface between the frame 31 and the top plate 11 of the base 1, and thus, even if the supporting surface has a gap, the microwaves emitted from the gap are shielded by the microwave shield but not leaked to the exterior of the base 1, so that the problem of microwave leakage easily caused after the carrier plate 32 is changed is solved and the potential safety risk is eliminated.

Specifically, the supporting surface extends in the peripheral direction of the frame 31, and the frame 31 is generally a rectangular frame, so the contour of the supporting surface is generally also rectangular; however, if the structural design of the frame 31 is changed, the shape of the supporting surface is also changed accordingly, for example, if the frame 31 is circular or elliptic, the contour of the supporting surface is correspondingly circular or elliptic; for another example, if a supporting part matched with the top plate 11 of the base 1 is formed at the bottom of the frame 31, the shape of the supporting surface is determined by the shape of the bottom of the supporting part.

In the above technical solution, preferably, the microwave shield is choke teeth 4.

In this solution, the microwave shield is choke teeth 4, the openings of the choke teeth 4 face the supporting surface between the frame 31 and the top plate 11 of the base 1, and the microwaves leaked from the supporting surface enter the choke teeth 4 from the openings of the choke teeth 4 and is prevented from being further propagated to the outside, thereby preventing the microwave from being leaked out of the base 1.

In any above technical solution, preferably, the carrier plate 32 is a glass plate, and the frame 31, the top plate 11 and the choke teeth 4 are all metal parts. The carrier plate 32 is fixedly bonded to the frame 31, and the choke teeth 4 are fixedly welded on the top plate 11.

In any above technical solution, preferably, the frame 31 is detachably connected to the top plate 11 via screws.

In this solution, the cooking platform 3 is fixed to the top plate 11 of the base 1 via screws, and with this design, the operation of detaching and mounting the cooking platform 3 is simple and the cooking platform 3 is convenient to replace.

In any above technical solution, preferably, the outer edge of the top plate 11 extends downward to form a first fixing rib 111, the first fixing rib 111 is provided with first fixing holes 1111 for mounting screws, the outer edge of the frame 31 extends downward to form a second fixing rib 311, the second fixing rib 311 is provided with second fixing holes 3111 for mounting screws, and when the cooking platform 3 is mounted on the top plate 11, the second fixing rib 311 is located outside the first fixing rib 111, and the second fixing holes 3111 and the first fixing holes 1111 are aligned and connected by the screws.

In any above technical solution, preferably, a seal ring 8 is mounted on the supporting surface.

When food put on the carrier plate 32 is heated, some water and oil may seep out of the food; if the connection part of the carrier plate 32 and the frame 31 is not well sealed and has a gap, water and oil easily flow from the gap to the top plate 11 of the base 1, and then flow into the base 1 along the top plate 11 of the base 1 and contact electric devices in the base 1, causing the problem of damage of the electric devices or short circuit. In order to prevent the problem, in this solution, a seal ring 8 is mounted on the supporting surface, the upper surface of the seal ring 8 abuts against the lower surface of the frame 31, and the lower surface of the seal ring 8 abuts against the upper surface of the top plate 11 of the base 1 to realize sealing, thereby preventing water and oil generated when the food is heated from flowing into the base 1.

In any above technical solution, preferably, the magnetron 5 is mounted below the mounting cavity 110 and connected to the bottom walls of the mounting cavity 110 via a waveguide tube to emit microwaves into the mounting cavity 110, and heat insulation batts 7 are arranged on the bottom walls and side walls of the mounting cavity 110 and cover the bottom walls and side walls of the mounting cavity 110.

In this solution, the heat insulation batts 7 cover the bottom walls and side walls of the mounting cavity 110, microwaves can penetrate the heat insulation batts 7, but the heat insulation batts 7 can prevent heat generated by the heating tube 6 from being transferred to the outside from the bottom walls and side walls of the mounting cavity 110 to reduce heat loss, so that all the heat generated by the heating tube 6 is transferred to the carrier plate 32 to heat food, thereby improving the heating efficiency.

In any above technical solution, preferably, a mounting part for mounting the carrier plate 32 is formed at the inner edge of the frame 31, the mounting part includes a connecting ring rib extending downward from the inner edge of the frame 31 and a limiting ring rib extending inward from the lower end of the connecting ring rib, the carrier plate 32 is mounted inside the connecting ring rib, and the lower surface of the carrier plate 32 is fixedly connected to the limiting ring rib.

In this solution, a mounting part that is concave downward is formed at the inner edge of the frame 31 and used for mounting the carrier plate 32, and the longitudinal section of the mounting part is L-shaped, so the structure is simple and the machining difficulty is low. The carrier plate 32 is mounted inside the mounting part, so that the fixing effect of the carrier plate 32 and the frame 31 can be improved and the edge of the carrier plate 32 can be prevented from scratching a user.

In any above technical solution, preferably, when the cooking platform 3 is mounted on the top plate 11, the lower surface of the limiting ring rib is matched with the upper surface of the top plate 11 to form the supporting surface, and the microwave shield is located between the connecting ring rib and the second fixing rib 311.

In the description of the present disclosure, the directions or position relations indicated by the terms "upper", "lower", "top", "bottom" and the like are the ones based on the accompanying drawings, are merely used for facilitating describing the present disclosure and simplifying the description, rather than indicating or implying that the described devices or elements must have specific directions or be constructed and operated in specific directions, and thus should not be understood as limiting the present disclosure.

In the description of the specification, the terms "one embodiment", "some embodiments", "specific embodiment" and the like are used to mean that the specific feature, structure, material or characteristic described in conjunction with the embodiment or example is included in at least one embodiment or example of the present disclosure. In the specification, the schematic expression of said terms does not necessarily indicate the same embodiment or example. Besides, the described specific feature, structure, material or characteristic may be combined in any one or more embodiments or examples in an appropriate mode.

In the description of the present disclosure, the terms "first" and "second" are merely used for description, and cannot be understood as indicating or implying the relative importance, unless otherwise specified and defined; and the terms "connected", "mounted", "fixed" and the like should be understood in a broad sense, for example, the term "connected" may be fixedly connected, detachably connected, integrally connected, directly connected, or indirectly connected via a medium. Those of ordinary skill in the art could understand the specific meanings of said terms in the present disclosure according to specific conditions.

Described above are merely preferred embodiments of the present disclosure, which are not used for limiting the present disclosure. Various modifications and changes may be made to the present disclosure for those skilled in the art. Any modification, equivalent substitution, improvement and the like made within the spirit and principle of the present disclosure shall fall into the protection scope of the present disclosure.

What is claimed:

1. A cooking appliance, comprising:

a base and an oven door articulated with the base; and a cooking platform and a microwave shield, wherein the cooking platform comprises a frame and a carrier plate mounted on the frame, the carrier plate is made of a non-microwave shielding material, the frame is detachably mounted on a top plate of the base via screws, an outer edge of the top plate extends downward to form a first fixing rib provided with first fixing holes for mounting the screws, an outer edge of the frame extends downward to form a second fixing rib, the second fixing rib is provided with second fixing holes for mounting the screws, and when the cooking platform is mounted on the top plate, the second fixing rib is located outside the first fixing rib, and the second fixing holes and the first fixing holes are aligned and connected by the screws, an abutting supporting surface is formed between a lower surface of the frame and an upper surface of the top plate, a magnetron is mounted at a bottom of the top plate, the magnetron is used for emitting microwaves from an inner side of the supporting surface to the carrier plate, and the microwave shield is mounted on the top plate, surrounds an outer side of the supporting surface and is used for shielding the microwaves leaked from the supporting surface.

2. The cooking appliance of claim 1, wherein the microwave shield is choke teeth.

3. The cooking appliance of claim 2, wherein a seal ring is mounted on the supporting surface.

4. The cooking appliance of claim 3, wherein the carrier plate is a glass plate, and the frame, the top plate and the choke teeth are all metal parts.

5. The cooking appliance of claim 4, wherein the carrier plate is fixedly bonded to the frame, and the choke teeth are fixedly welded on the top plate.

6. The cooking appliance of claim 2, wherein a mounting cavity that is concave downward is formed in the upper surface of the top plate, the mounting cavity is used for mounting a heating tube and is opposite to the carrier plate, and heat insulation batts are arranged on bottom walls and side walls of the mounting cavity and cover the bottom walls and side walls of the mounting cavity.

7. The cooking appliance of claim 6, wherein the carrier plate is a glass plate, and the frame, the top plate and the choke teeth are all metal parts.

8. The cooking appliance of claim 7, wherein the carrier plate is fixedly bonded to the frame, and the choke teeth are fixedly welded on the top plate.

9. The cooking appliance of claim 2, wherein a mounting part for mounting the carrier plate is formed at an inner edge of the frame, the mounting part comprises a connecting ring rib extending downward from the inner edge of the frame and a limiting ring rib extending inward from the lower end of the connecting ring rib, the carrier plate is mounted inside the connecting ring rib, and the lower surface of the carrier plate is fixedly connected to the limiting ring rib.

10. The cooking appliance of claim 9, wherein the carrier plate is a glass plate, and the frame, the top plate and the choke teeth are all metal parts.

11. The cooking appliance of claim 9, wherein when the cooking platform is mounted on the top plate, the lower surface of the limiting ring rib is matched with the upper surface of the top plate to form the supporting surface, and the microwave shield is located between the connecting ring rib and the second fixing rib.

12. The cooking appliance of claim 11, wherein the carrier plate is a glass plate, and the frame, the top plate and the choke teeth are all metal parts.

13. The cooking appliance of claim 2, wherein the carrier plate is a glass plate, and the frame, the top plate and the choke teeth are all metal parts.

14. The cooking appliance of claim 13, wherein the carrier plate is fixedly bonded to the frame, and the choke teeth are fixedly welded on the top plate.

* * * * *